US008291699B2

(12) United States Patent
Payri González et al.

(10) Patent No.: US 8,291,699 B2
(45) Date of Patent: Oct. 23, 2012

(54) EXHAUST MANIFOLD OF A TURBO-SUPERCHARGED RECIPROCATING ENGINE

(75) Inventors: Francisco Payri González, Valencia (ES); José Maria Desantes Fernández, Valencia (ES); José Galindo Lucas, Valencia (ES); José Ramón Serrano Cruz, Valencia (ES)

(73) Assignee: Universidad Politecnica de Valencia, Valencia (ES)

( * ) Notice: Subject to any disclaimer, the term of this patent is extended or adjusted under 35 U.S.C. 154(b) by 0 days.

(21) Appl. No.: 13/207,482

(22) Filed: Aug. 11, 2011

(65) Prior Publication Data

US 2012/0023929 A1 Feb. 2, 2012

Related U.S. Application Data

(63) Continuation of application No. PCT/ES2010/000050, filed on Feb. 8, 2010.

(30) Foreign Application Priority Data

Feb. 13, 2009 (ES) ..... 200900483

(51) Int. Cl.
*F01N 3/02* (2006.01)

(52) U.S. Cl. ..... 60/323; 60/280; 60/295; 60/298; 60/302; 60/311; 60/320; 60/598; 60/605.1

(58) Field of Classification Search ..... 60/278, 60/280, 295, 297, 298, 302, 311, 320, 323, 60/598, 605.1, 605.2
See application file for complete search history.

(56) References Cited

U.S. PATENT DOCUMENTS

| | | | | |
|---|---|---|---|---|
| 4,887,427 | A * | 12/1989 | Shinzawa et al. | 60/286 |
| 5,220,789 | A * | 6/1993 | Riley et al. | 60/302 |
| 5,488,826 | A * | 2/1996 | Paas | 60/299 |
| 5,930,995 | A * | 8/1999 | Watanabe et al. | 60/311 |
| 6,729,128 | B2 * | 5/2004 | Shiratani et al. | 60/297 |
| 7,552,586 | B1 * | 6/2009 | White | 60/302 |
| 2007/0095054 | A1 | 5/2007 | Goebelbecker | |

FOREIGN PATENT DOCUMENTS

| | | |
|---|---|---|
| DE | 10 2005 025 731 | 12/2006 |
| EP | 1 229 221 | 8/2002 |
| JP | 52-56220 | 5/1977 |
| JP | 2002-364335 | 12/2002 |
| JP | 2005-232996 | 9/2005 |

OTHER PUBLICATIONS

International Search Report issued May 24, 2010 in International (PCT) Application No. PCT/ES2010/000050.

* cited by examiner

*Primary Examiner* — Binh Q Tran
(74) *Attorney, Agent, or Firm* — Wenderoth, Lind & Ponack, L.L.P.

(57) ABSTRACT

Exhaust manifold of a turbo-supercharged reciprocating engine with any number of cylinders ranging from 2 to 6 and equipped with an EGR system which comprises: a) an outer casing (21) which includes flanges (23, 25) for effecting joining, respectively, to the cylinder head (13) of the engine and the turbine (15) and an opening towards an EGR outlet duct (27) and an inner wall (31) with low thermal inertia defining a regulating chamber (33) for the exhaust gases introduced into it, after passing through a particle filter (45), via a plurality of orifices (35) located in the inner wall (31); b) inner branches (41) for entry of the exhaust gases, situated opposite the exhaust pipes (17); c) an outlet duct (59) for conveying the exhaust gases to the turbine (15), designed as an extension of the inner wall (31).

18 Claims, 2 Drawing Sheets

EXHAUST MANIFOLD OF A TURBO-SUPERCHARGED RECIPROCATING ENGINE

This application is a Continuation of international application PCT/ES2010/000050, filed Feb. 8, 2010, the entirety of which is hereby incorporated by reference.

FIELD OF THE INVENTION

The present invention relates to an exhaust manifold of a turbo-supercharged reciprocating engine with any number of cylinders ranging from 2 to 6 with particle filter and exhaust gas recirculation (EGR).

BACKGROUND OF THE INVENTION

Among the various issues raised by the exhaust gases from turbo-supercharged diesel engines should be highlighted, for the purposes of the present invention, those related to the cleaning of carbon particles, recirculation to the engine intake and those concerning the use of their energy.

In the prior art are known several proposals for cleaning the exhaust gases of Diesel engines before discharging to the atmosphere both in relation to the removal of pollutant particles that contain carbon and hydrocarbons and to the reduction of the content of nitrogen oxides.

As for the removal of pollutant particles different proposals that use different types of filters are known. One is described in the patent EP 0 823 545 using particle filters, and other is described in patent ES 2155646 particularly using 'collection by shock' type filter, wherein the holes of the mesh have a greater size than the particles and which only trap the particles colliding with the walls of the mesh.

As for the reduction of the content of nitrogen oxides is well known the technique, generally referenced with the initials EGR, for recirculating at least a fraction of the exhaust gases towards the engine intake duct, knowing several concrete proposals both relating to the design of the recirculation loop and to the regulation and control of gas flow that is recirculated.

Finally, various proposals for using the energy of the exhaust gases in the turbogenerators of supercharged engines are also known.

While the prior art provides effective solutions for each individual issue mentioned above, the automotive industry continually requires effective solutions to the problems identified in a whole requiring a proper balance between the energy loss that inevitably occurs in any process for cleaning exhaust gases and the desirable degree of utilization of the energy of the exhaust gases into the turbogenerator.

The present invention is directed to meeting that requirement.

SUMMARY OF THE INVENTION

An object of the present invention is an exhaust manifold of an internal combustion Diesel engine, with any number of cylinders ranging from 2 to 6, turbo-supercharged and equipped with an EGR system that simultaneously contributes to achieve a high degree for cleaning the exhaust gases and achieving a high degree for using their energy.

Another object of the present invention is an exhaust manifold of an internal combustion Diesel engine, with any number of cylinders ranging from 2 to 6, turbo-supercharged and equipped with an EGR system, which in turn reduces the thermal inertia and fluid dynamic phenomena when conveying the exhaust gases to the turbine, and improves the transient response of the turbo-supercharged engine.

These and other objects are achieved by providing an exhaust manifold that includes at least one particle filter for retaining the particles contained in the exhaust gases, which comprises:

a) An outer casing which includes flanges for effecting joining, respectively, to the cylinder head of the engine and the turbine and an opening towards an EGR outlet duct and an inner wall substantially parallel to the outer casing area located between said flanges and with lower thermal inertia than the outer casing, defining a regulating chamber for the exhaust gases introduced into it via a plurality of orifices located in said inner wall, downstream of said at least one particle filter.

b) Inner branches for entry of the exhaust gases situated opposite the exhaust pipes.

c) An outlet duct for conveying the exhaust gases to the turbine designed as an extension of the inner wall.

In a preferred embodiment of the invention various particle filters of small size are embedded in the initial part of the inner branches. This is achieved with a compact manifold which minimizes the heat transfer surface with the exterior and the volume in which the exhaust gases are expanded when reaching thereof. Both phenomena reduce, respectively, the heat losses and the losses of kinetic energy of the exhaust gases.

In another preferred embodiment of the invention a single particle filter, of standard size for the engine cylinder capacity, is embedded in a filter channel set at the end of the manifold before the outlet duct. This achieves a manifold with higher volume and heat transfer surface, but that makes the entry of the particle filter to be at the point of the manifold where the temperature and the uniformity of the flow of exhaust gases are maximum. Therefore, it facilitates the self-regeneration of the particle filter. In addition, the particle filter size required is commercially available which will lower the cost for manufacturing the system.

In another preferred embodiment of the invention the material of the particle filters is a ceramic material. This achieves a manifold which effectively minimizes the transient heat losses of exhaust gases when cleaning the particles therein, thereby improving the transient response of the engine during the accelerations thereof.

In another preferred embodiment of the invention, the difference in thickness between the outer casing and the inner wall is at least 1.5 mm, for the same material, e.g. stainless steel. This achieves a manifold with low thermal inertia in its inner wall which provides an appropriate balance between the temperature of the gases that are recirculated (EGR) and the temperature of the gases conveyed towards the turbine.

In another preferred embodiment of the invention, the manifold also includes tubes attached to the flange for effecting joining to the cylinder head of the engine which are introduced into the exhaust pipes of the engine in order to prevent the exhaust gases from contacting with the cylinder head. This achieves a manifold with exhaust gases at a higher temperature and with a high degree of efficiency for using the useful surface of the particle filter for cleaning pollutant particles from the exhaust gases when the particle filters are embedded in the initial part of the inner branches.

Other features and advantages of the present invention will become apparent from the following detailed description of illustrative embodiments, and in no way limiting, its purpose in connection with the accompanying drawings.

DETAILED DESCRIPTION OF THE INVENTION

The turbo-supercharged Diesel engines, with any number of cylinders ranging from 2 to 6 cylinder which the present invention refers to, have, as is well known, an intake duct for supplying air to the engine cylinders and a duct or manifold for the exhaust gases resulting from the combustion, which conveys the exhaust gases towards the turbine of a turbogenerator. In addition a certain fraction of the exhaust gases (EGR) is usually recirculated from the exhaust manifold to the intake pipe after subjecting thereof to a cooling process, in order to reduce the amount of NOx emissions.

Figure 1:
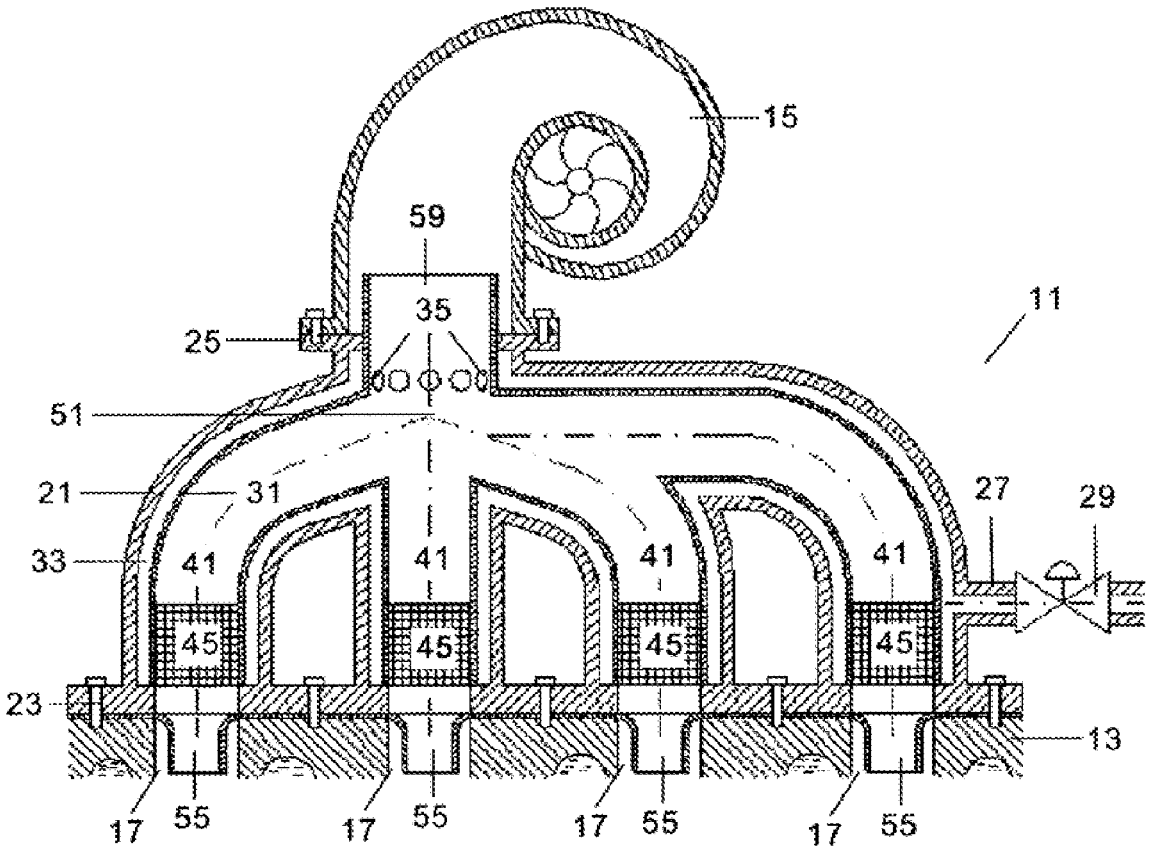
FIG. 1 shows a cross-sectional view of a first embodiment of an exhaust manifold of a turbo-supercharged reciprocating engine of 4 cylinders according to the present invention.

FIG. 1 is a schematic illustration of an exhaust manifold 11 according to a first preferred embodiment of the present invention disposed between the cylinder head 13 of a 4-cylinder Diesel engine with the aforementioned topology and the turbine 15.

The basic elements of the exhaust manifold 11 design in the preferred embodiment being described are:

- An outer casing 21 of 2.5 mm thick made of cast iron or stainless steel including flanges 23 to 25 for effecting joining, respectively, to the cylinder head 13 of the engine and the turbine 15 and an opening towards an outlet duct 27 of the exhaust gas intended to (EGR) recirculation controlled by an EGR valve 29.
- An interior wall 31 of 1 mm thick made of iron or stainless steel substantially parallel to the area of the outer casing 21, located between the flanges 23, 25, defining a EGR regulating chamber 33 introduced into it through at least a plurality of orifices of ports 35 in the inner wall 31. An important feature of the present invention is that the thermal inertia of the inner wall 31 (the thermal inertia being defined as the product of the density of the material by its specific heat) should be as low as possible and consistent with the integrity of the material and in any case, lower than that of the outer casing of 21. Material equality means that the difference in thickness between the outer casing 21 and the inner wall 31 must be at least 1.5 mm.
- Four branches 41 for entry the exhaust gases to the manifold 11, constructed with thin thickness and with a low thermal inertia material, situated opposite the four exhaust pipes 17 of the engine with particle filters 45 embedded in its initial part. The particle filters 45 are of a low thermal inertia material, preferably of a ceramic material.
- An outlet duct 59 for conveying the exhaust gases towards the turbine 15 designed as an extension of the inner wall 31.
- Four tubes 55 inserted into the straight part of the four exhaust pipes 17 of the engine.

This configuration provides a compact manifold 11, with integrated particle filters 45, with a small surface for transferring heat towards the outside that helps keeping the temperature of the exhaust gases until reaching the turbine 15 and with a small inner volume that reduces the fluid inertia phenomena of the exhaust gases when are conveyed towards the turbine 15 and, improves the transient response of the turbo-supercharged engine due to the reduction of the acceleration transient of the turbogenerator during load increases in the engine. Among its outstanding technical features and advantages the following should be highlighted:

a) The particle filters 45 embedded in the inlet branches 41 are located at the inlet of the manifold 11 just at the outlet of the exhaust pipes 17, which are the discharge ducts of the cylinders cast in the cylinder head 13 of the engine, and therefore upstream of the turbine 15 as opposed to a position downstream of the turbine 15, which is the position to be considered as standard in the prior art, although manifolds with particle filters located upstream of the turbine 15 are also known.

The location of the particle filters 45 in the four branches 41 allows approximating the front section of each filter 45 to the geometric section of each exhaust pipe 17 thereby achieving an increase in the efficiency of the filtration area of the filters 45. In turn, the fact that the particle filters 45 are made of a very low thermal inertia material makes the thermal transient, until its balance conditions, to be very limited in time and does not represent a limitation for the available energy in the turbogenerator, and therefore in the transient response of the same during load increases in the engine. It likewise allows a self-regenerating of the particle filters 45 by the self-oxidation of carbon and hydrocarbon particles trapped therein due to the high temperature of the exhaust gases at the outlet of the exhaust pipes 17 of the engine. The self-regeneration prevents the use of fuel additives, lowering the maintenance cost and simplifying the engine. The self-regeneration also prevents the fuel injection for regenerating the filters, which improves the average performance of the engine.

In turn, the position of the particle filters 45 upstream of the turbine 15 and close to the exhaust pipes 17 of the engine increases the back pressure of the cylinders during the discharge period of the exhaust valves. This reduces the pressure drop in the exhaust valves and thus reduces the time period in which sonic conditions are produced in these valves. The reduction of the period in sonic conditions makes to reduce, in turn, the important processes for laminating the energy occurring during sonic conditions. Therefore, the energy available in the exhaust gases is increased to be used by the turbine 15 of the supercharging group. This results, on the one hand, in an improvement of the transient response of the turbogenerator during load increases in the engine. On the other hand, in an improvement of the overall efficiency of the engine if the turbine were controlled by a 'waste-gate' (valve that derives the exhaust gases directly downstream of the turbine without passing through it) or had a variable geometry (as occurs in practically all modern supercharged engines) and, it is achieved that the turbine (or 'waste-gate') work in a more open position.

In turn, the placement of the particle filters 45 upstream of the turbine 15 reduces engine back pressure and increases the enthalpy jump in the turbine 15, and therefore also increases the energy that the turbine 15 can recover. If the turbine is controlled by a 'waste-gate' or has variable geometry, this also results in an improvement of the overall engine performance. The reason is that the lamination of the flow of gases produced in the particle filter 45 reduces the pressure upstream of the turbine 15 but less than when the filter is downstream of the turbine, due to the higher density of the exhaust gases at this location. In addition, the lamination of the gases in the filter maintains the enthalpy of the exhaust gases. Therefore, when these are expanded in the turbine 15, they can do it almost up to the atmospheric pressure because the particles filters 45 have been displaced from their traditional position downstream of the turbine.

Additionally, during the processes for regenerating the particle filters a higher temperature of the exhaust gases upstream of the turbine 15 will be obtained, and therefore more energy available therein, which will result in an improvement of the efficiency and transient response of the engine. The higher temperature of the exhaust gases will also help in the catalytic phenomena (caused in the catalyst, located downstream of the turbine 15) during the phases for regenerating the filters 45.

b) The double-walled design provided by a conventional outer casing 21 and an inner wall 31 with low thermal inertia allows the recirculation of exhaust gases through the regulating chamber 33. The EGR comes out through the orifices 35 made into the inner wall 31 and occupies the chamber 33 existing between the inner wall 31 and the outer casing 21. The EGR will be evacuated from this chamber 33 through a solenoid 29 controlled by the engine control unit (ECU) and coupled to an outlet duct 27 of the manifold 11. The orifices 35 and the outlet duct 27 are located at opposite ends of the manifold 11, the first ones in a position close to the flange 25 and back to the union of the branches of the manifold (shown in FIG. 1 by the item 51), wherein the exhaust gases have a higher temperature, and the second one in a position close to the flange 23, so that the EGR flow fills the entire chamber 33 between the inner wall 31 and the outer casing 21. The purpose of this filling is double, to achieve, on the one hand, a first degree for cooling the EGR in the chamber 33 and, secondly, to heat the exhaust gases inside the collection chamber formed by the wall 31.

Because the EGR is recirculated from a position downstream of the particle filters 45 and upstream of the turbine 15, a high pressure and particles-free EGR is obtained. In turn, the EGR is partially cooled by passing it through the chamber 33 located between the outer casing 21 and the inner wall 31. This makes possible the introduction of the EGR into the intake circuit, at a point downstream of the centrifugal compressor. The possibility of connecting the EGR line between a high pressure zone and another with low pressure allows producing very high EGR rates as will be required by future engines.

Moreover, the reduction of thermal inertia on the inner wall 31 of the manifold 11 and the increase of thermal insulation due to the double wall provided by the outer casing 21 and the inner wall 31 helps to increase the energy available in the exhaust gases at the turbine inlet 15 in both the transition phases and stationary phases of the engine, which will results, on the one hand, in an improvement of the dynamic response of the turbogenerator and therefore of the engine during transients, and on the other hand, in an improvement of the overall efficiency of the engine in the case of variable geometry turbine or with 'waste-gate', the improvement being more or less as the control of the turbine 15 is. In turn, heating the inner wall 31 of the manifold 11 under those engine operating conditions in which the EGR valve 29 opens and the EGR flow is produced between the inner wall 31 and the outer casing 21 of the manifold 11 (mostly under low load degree conditions) provides similar benefits for the transient response and engine performance.

c) The four tubes 55 inserted at the end of the exhaust pipes 17 have a conical shape diverging in their area for attaching to the flange 23 in order to distribute the exhaust gases across the front section of the particle filters 45, thus achieving an increase in its filtration efficiency.

d) The design of the outlet duct 59 as an extension of the inner wall 31 allows extending the double wall within the turbine 15 thus achieving an ejector effect which difficult the gas reflux into the EGR outlet duct 27.

Figure 2:
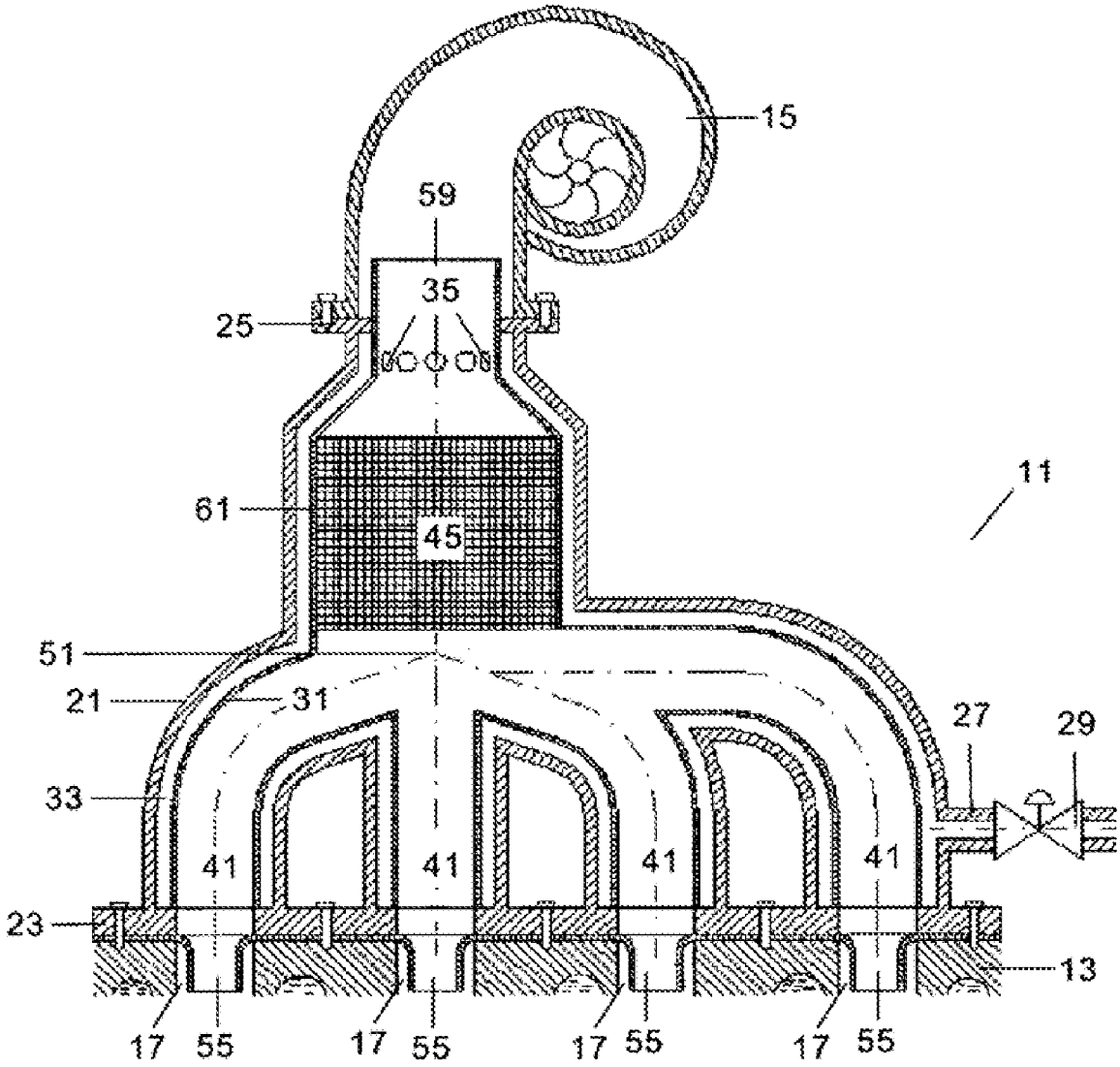
FIG. 2 shows a cross-sectional view of a second embodiment of an exhaust manifold of a turbo-supercharged reciprocating engine of 4 cylinders according to the present invention.

FIG. 2 illustrates a second preferred embodiment of the invention main difference of which with the embodiment just being described is that the particle filter 45 is not divided into several parts embedded in the inner branches 41 but remains as an assembly embedded into a filtering channel 61 designed in the back of the manifold 11 before the outlet duct 59.

Except for what concerns to this aspect, the basic elements of the design of the exhaust manifold 11 in the preferred embodiment being described are identical to the previous design.

This design provides a manifold 11 with particle filter 45 integrated at item 51 of the manifold, wherein the exhaust gases reach the maximum temperature inside the manifold 11 and its flow is more uniform, which facilitates the self-regeneration of the filter. However, the compact quality that has the design shown in FIG. 1 is lost, so that in order to maintain or improve the transient response of the turbo-supercharged engine, due to the reduction of the acceleration transient of the turbogenerator during load increases in the engine, the manifold 11 has thermal insulation provided by the chamber 33 and with low thermal inertia of the inner wall 31 and the ceramic material of the filter 45.

Therefore, among its notable technical features and advantages the following should be highlighted:

a) The particle filter 45 embedded in a filtering channel 61 configured in the back of the manifold 11 before the outlet duct 59 and therefore upstream of the turbine 15 as opposed to a position downstream of the turbine 15 which is the position to be considered as standard in the prior art but, although manifolds with particle filters located upstream of the turbine 15 are also known.

The location of a particle filter 45, solely and integrated into the filtering channel 61 allows the use of standard ceramic particle filters widely commercialized, which lowers the cost for constructing the system.

In turn, the fact that the particle filter 45 is a very low thermal inertia material makes the thermal transient, until its balance conditions, to be very limited in time and does not represent a limitation for the energy available in the turbogenerator, and therefore in the transient response of the same during load increases in the engine. It likewise allows a self-regeneration of the particle filter 45 by the self-oxidation of carbon and hydrocarbon particles trapped therein due to the high temperature of exhaust gases at item 51 of the manifold. The self-regeneration prevents the use of fuel additives, lowering the maintenance cost and simplifying the engine. The self-regeneration also prevents the fuel injection in order to regenerate the filters, which improves the average performance of the engine.

In turn, the placement of the particle filter 45 upstream of the turbine 15 reduces the engine back pressure and increases the enthalpy jump in the turbine 15, and therefore also increases the energy that the turbine 15 can recover. If the turbine is controlled by a 'waste-gate' or has a variable geometry, this also results in an improvement on the overall engine performance. The reason is that the lamination of the flow of gases produced in the particle filter 45 reduces the pressure upstream of the turbine 15 but less than when the filter is downstream of the turbine, due to the higher density of exhaust gases at this location. In addition, the lamination of the gases in the filter maintains the enthalpy of the exhaust gases. Therefore, when these are expanded in the turbine 15, can do it almost up to the atmospheric pressure because the particle filter 45 has been moved from its traditional position downstream of the turbine.

Additionally, during the processes for regenerating the particle filter 45 a higher temperature of the exhaust gases upstream of the turbine 15 will be obtained, and therefore more energy is available therein, which will result in an improvement on the efficiency and transient response of the engine. The higher temperature of the exhaust gases will also help in the catalytic phenomena (occurring in the catalyst, located downstream of the turbine 15) during the phases for regenerating the filter 45.

b) The double-walled design provided by a conventional outer casing 21 and an inner wall 31 with low thermal inertia allows the recirculation of exhaust gases through the regulating chamber 33. The EGR comes out through the orifices 35 made into the inner wall 21 and occupies the chamber 33 existing between the inner wall 31 and the outer casing 21. The EGR will be evacuated from this chamber 33 through a solenoid 29 controlled by the engine control unit (ECU) and coupled to an outlet duct 27 of the manifold 11. The orifices 35 and the outlet duct 27 are located at opposite ends of the manifold 11, the first ones in a position close to the flange 25 and back to the particle filter 45, and the second one in a position close to the flange 23, so that the EGR flow fills the entire chamber 33 between the inner wall 31 and the outer casing 21. The purpose of this filling is double, to achieve, on the one hand, a first degree for cooling the EGR in the chamber 33 and, secondly, to heat the exhaust gases inside the filter 45 and the collection chamber formed by the wall 31.

Because the EGR is recirculated from a position downstream of the particle filter 45 and upstream of the turbine 15, a high pressure and particles-free EGR is obtained. In turn, the EGR is partially cooled by passing it through the chamber 33 located between the outer casing 21 and the inner wall 31. This makes possible the introduction of the EGR into the intake circuit, at a point downstream of the centrifugal compressor. The possibility of connecting the EGR line between a high pressure zone and another with low pressure allows producing very high EGR rates as will be required by future engines.

Moreover, the reduction of thermal inertia on the inner wall 31 of the manifold 11 and the increase of thermal insulation due to the double wall provided by the outer casing 21 and the inner wall 31 helps to maintain or increase the energy available in the exhaust gases at the turbine inlet 15 in both the transition phases and stationary phases of the engine, which will results, on the one hand, in maintaining or improving the dynamic response of the turbogenerator and therefore of the engine during transients, and on the other hand, in an improvement of the overall efficiency of the engine in the case of turbines with variable geometry or with 'waste-gate', the improvement being more or less as the control of the turbine 15 is. In turn, heating the inner wall 31 of the manifold 11 under those engine operating conditions in which the EGR valve 29 opens and the EGR flow is produced between the inner wall 31 and the outer casing 21 of the manifold 11 (mostly under low load degree conditions) provides similar benefits for the transient response and engine performance.

c) The four tubes 55 inserted at the end of the exhaust pipes 17 contribute to increase the exhaust gas temperature in the manifold 11 by forming a blind chamber between them and the walls of the exhaust pipes 17, preventing the exhaust gases from cooling when contacting with the walls of the cylinder head 13. The four tubes 55 have a conical shape diverging in their area of attachment to the flange 23 in order to reduce the load losses in the flow during the section change suffered when passing from the tubes 55 to the branches 41.

d) The design of the outlet duct 59 as an extension of the inner wall 31 allows extending the double wall within the turbine 15 thereby achieving an ejector effect which makes difficult the gas reflux into the EGR outlet duct 27.

In short, there can be said that the manifold object of the present invention allows achieving the following synergic effects:

The arrangement of the particle filter(s) 45 upstream of the turbine 15 and the better use of the energy from exhaust gases into the turbine which entails an improvement on the specific fuel consumption of the engine by better utilization of the viscous-elastic phenomena of the exhaust gases (lower net back pressure for the engine and higher expansion of the exhaust gases in the turbine).

The embedded location of the particle filter(s) 45 whether in the inner branches 41 of the manifold 11 in the first embodiment, or in the filtering channel 61 in the second embodiment of the invention together with the existence of the chamber 33 between the outer casing 21 and the inner wall 21 allows outputting an EGR flow from the manifold 11, which is on the one hand, clean from particles, and on the other has a certain degree of cooling.

The chamber 33 between the outer casing 21 and the inner wall 31 provides a high degree of isolation for the exhaust gases which, after passing through the particle filters 45, reach the turbine 15 minimizing the temperature losses, which represents an improvement in both the regeneration of particle filters and the amount of energy recovered in the turbine 15.

With respect to the described embodiments of the invention, modifications can be made within the scope defined by the following claims.

The invention claimed is:

1. Exhaust manifold (11) of a turbo-supercharged Diesel engine with any number of cylinders ranging from 2 to 6 and equipped with an EGR system, which comprises at least one particle filter (45) for retaining the particles contained in the exhaust gases, characterized in that it includes:

a) an outer casing (21) which includes flanges (23, 25) for effecting joining, respectively, to the cylinder head (13) of the engine and the turbine (15) and an opening towards an EGR outlet duct (27) and an inner wall (31), substantially parallel to the area of the outer casing (21) located between the flanges (23, 25) and with low thermal inertia than the outer casing (21), defining a regulating chamber (33) for the exhaust gases introduced into it via a plurality of orifices (35) located in the inner wall (31) downstream of said at least one particle filter (45);

b) inner branches (41) for entry of the exhaust gases, situated opposite the exhaust pipes (17);

c) an outlet duct (59) for conveying the exhaust gases to the turbine (15), designed as an extension of the inner wall (31).

2. Exhaust manifold (11) according to claim 1, characterized in that it includes particle filters (45) embedded in the initial part of each of the inner branches (41).

3. Exhaust manifold (11) according to claim 1, characterized in that it includes a particle filter (45) embedded in a filtering channel (61) set at the end of the manifold (11) before the outlet duct (59).

4. Exhaust manifold (11) according to claim 1, characterized in that the material of the particle filters (45) is a ceramic material.

5. Exhaust manifold (11) according to claim 1, characterized in that, for the same material, the difference in thickness between the casing (31) and the inner wall (21) is at least 1.5 mm.

6. Exhaust manifold (11) according to claim 1, characterized in that it also includes tubes (55) attached to the flange (23) which are introduced into the exhaust pipes (17) in order to prevent the exhaust gases from contacting with the cylinder head (13) and facilitating their entry to the manifold (11).

7. Exhaust manifold (11) according to claim 1, characterized in that said orifices (35) are located in the vicinity of the flange (25) for effecting joining to the turbine (15).

8. Exhaust manifold (11) according to claim 1, characterized in that said EGR outlet duct (27) is located in the vicinity of the flange (23) for effecting joining to the cylinder head (13).

9. Exhaust manifold (11) according to claim 2, characterized in that the material of the particle filters (45) is a ceramic material.

10. Exhaust manifold (11) according to claim 3, characterized in that the material of the particle filters (45) is a ceramic material.

11. Exhaust manifold (11) according to claim 2, characterized in that, for the same material, the difference in thickness between the casing (31) and the inner wall (21) is at least 1.5 mm.

12. Exhaust manifold (11) according to claim 3, characterized in that, for the same material, the difference in thickness between the casing (31) and the inner wall (21) is at least 1.5 mm.

13. Exhaust manifold (11) according to claim 2, characterized in that it also includes tubes (55) attached to the flange (23) which are introduced into the exhaust pipes (17) in order to prevent the exhaust gases from contacting with the cylinder head (13) and facilitating their entry to the manifold (11).

14. Exhaust manifold (11) according to claim 3, characterized in that it also includes tubes (55) attached to the flange (23) which are introduced into the exhaust pipes (17) in order to prevent the exhaust gases from contacting with the cylinder head (13) and facilitating their entry to the manifold (11).

15. Exhaust manifold (11) according to claim 2, characterized in that said orifices (35) are located in the vicinity of the flange (25) for effecting joining to the turbine (15).

16. Exhaust manifold (11) according to claim 3, characterized in that said orifices (35) are located in the vicinity of the flange (25) for effecting joining to the turbine (15).

17. Exhaust manifold (11) according to claim 2, characterized in that said EGR outlet duct (27) is located in the vicinity of the flange (23) for effecting joining to the cylinder head (13).

18. Exhaust manifold (11) according to claim 3, characterized in that said EGR outlet duct (27) is located in the vicinity of the flange (23) for effecting joining to the cylinder head (13).

* * * * *